US011280174B2

(12) United States Patent
Allara et al.

(10) Patent No.: US 11,280,174 B2
(45) Date of Patent: Mar. 22, 2022

(54) SYSTEM AND METHOD FOR DETERMINING THE SHAPE AND POSITION OF AN UNDERWATER RISER

(71) Applicant: SAIPEM S.P.A., Milan (IT)

(72) Inventors: Paolo Mario Alessandro Allara, Milan (IT); Davide Maria Gaviraghi, Milan (IT); Giuseppe Battista Abbate, Milan (IT)

(73) Assignee: SAIPEM S.P.A., Milan (IT)

( * ) Notice: Subject to any disclaimer, the term of this patent is extended or adjusted under 35 U.S.C. 154(b) by 208 days.

(21) Appl. No.: 16/611,352

(22) PCT Filed: May 8, 2018

(86) PCT No.: PCT/IB2018/053182
§ 371 (c)(1),
(2) Date: Nov. 6, 2019

(87) PCT Pub. No.: WO2018/207088
PCT Pub. Date: Nov. 15, 2018

(65) Prior Publication Data

US 2020/0165914 A1 May 28, 2020

(30) Foreign Application Priority Data

May 8, 2017 (IT) ..... 102017000049574

(51) Int. Cl.
*E21B 47/001* (2012.01)
*E21B 47/13* (2012.01)
(Continued)

(52) U.S. Cl.
CPC ..... *E21B 47/001* (2020.05); *E21B 17/01* (2013.01); *E21B 47/06* (2013.01); *E21B 47/07* (2020.05); *E21B 47/13* (2020.05); *E21B 47/007* (2020.05)

(58) Field of Classification Search
CPC ..... E21B 47/001; E21B 47/13; E21B 47/07; E21B 17/01; E21B 47/06; E21B 47/007
See application file for complete search history.

(56) References Cited

U.S. PATENT DOCUMENTS 7,328,741 B2 2/2008 Allen
2013/0168081 A1* 7/2013 Yang ..... E21B 47/13 166/247

(Continued)

FOREIGN PATENT DOCUMENTS

WO 8102442 A1 9/1981
WO 2012143673 A2 10/2012

(Continued)

OTHER PUBLICATIONS

Duraibabu et al., An Optical Fibre Depth (Pressure) Sensor for Remote Operated Vehicles in Underwater Applications, Sensors 2017, 17, 406 (Year: 2017).*

(Continued)

*Primary Examiner* — Regis J Betsch
(74) *Attorney, Agent, or Firm* — Cantor Colburn LLP

(57) ABSTRACT

A method for determining the shape and position of an underwater riser extending from a floating platform includes calculating a deformed shape of the riser by means of a numerical model of the deformed shape of the riser as a function of a plurality of acceleration values and of a plurality of position values in predetermined points of the riser, detecting acceleration values of the riser in a plurality of detection points along a longitudinal extension of the riser, detecting the water pressure values in at least some of the detection points, and calculating the position values as a function of the measured water pressure values.

22 Claims, 4 Drawing Sheets

(51) Int. Cl.

| | |
|---|---|
| ***E21B 47/07*** | (2012.01) |
| ***E21B 17/01*** | (2006.01) |
| ***E21B 47/06*** | (2012.01) |
| *E21B 47/007* | (2012.01) |

(56) References Cited

U.S. PATENT DOCUMENTS

| | | | | |
|---|---|---|---|---|
| 2015/0071032 | A1* | 3/2015 | Sillick | G01V 1/3808 367/21 |
| 2015/0346064 | A1* | 12/2015 | Liu | E21B 17/01 702/188 |
| 2016/0084066 | A1 | 3/2016 | Deberry | |

FOREIGN PATENT DOCUMENTS

| | | | |
|---|---|---|---|
| WO | 2015183491 | A1 | 12/2015 |
| WO | 2016089258 | A1 | 6/2016 |

OTHER PUBLICATIONS

Wang et al., "Improved Sensor Fault Detection, Isolation, and Mitigation Using Multiple Observers Approach", Int J Syst Sci Jan. 23, 2017 (Year: 2017).*

Kaushal et al., "Free Space Optical Communication: Challenges and Mitigation Techniques", Cornell University, arXiv: 1506.04836v1 [cs.IT] Jun. 16, 2015 (Year: 2015).*

International Search Report for corresponding application PCT/IB2018/053182 filed on May 8, 2018; dated Jul. 18, 2018.

Written Opinion of the International Searching Authority for corresponding application PCT/IB2018/053182 filed on May 8, 2018; dated Jul. 18, 2018.

* cited by examiner

SYSTEM AND METHOD FOR DETERMINING THE SHAPE AND POSITION OF AN UNDERWATER RISER

The invention relates to a system and method for determining the shape and position of an underwater riser.

TECHNICAL FIELD

In a typical offshore oil and natural gas drilling scheme, in deep and ultra-deep waters (500 m-4000 m), a floating unit acts as a drilling platform and is connected to a well, an installation or to a generic area of interest on the seabed, by means of tube bundles, the so-called risers, arranged for one or more specific functions, for example, the circulation of sludge, and more generally for the control of the well.

The tube bundles, hereinafter called risers for brevity, are elongated structures with very long longitudinal extension and slenderness, which may be made of a substantially rigid, flexible, elastic, elastoplastic, metal (in particular steel) or composite material, e.g., reinforced with fibers.

Typically, the riser consists of a plurality of flanged tubes connected together in series and connecting the floating platform to the wellhead. The riser is subject to the effects of the sea current and to the effects of the movement of the floating platform which determine, together with other conditions, the movement and the shape and position of the riser.

With the increase of the sea depths of drilling, the lengths of the risers, and consequently the mechanical stresses and deformations thereof, also increased.

On the other hand, the need is felt to know the shape and position of the riser as precisely as possible. In fact, when knowing the fixed position of the wellhead on the seabed, knowing the position and the deformation of the riser would allow determining exactly the floating platform, alternatively and/or additionally to a global, satellite location system, based on the transmission of electromagnetic signals, and alternatively and/or additionally to an acoustic location system (sonar), based on the propagation of acoustic waves.

The transmission of electromagnetic signals for a satellite location may be altered by adverse atmospheric events, while the propagation of acoustic waves in sea water may be affected and altered by changes in salinity, sea currents and differences in water temperature. Therefore, it is desirable to have a further possibility of locating the floating platform, based on a physical principle different from the long distance propagation of acoustic and electromagnetic waves.

In addition to determining the position of the floating platform, knowing the position and deformation of the riser would also allow knowing more precisely the position of the lower end of the riser during the approach and connection thereof to the wellhead on the seabed.

Lastly, but not less importantly, knowing the position and deformation of the riser would also allow a more precise estimation of the mechanical stresses and of the fatigue damage of the riser in order to arrange for maintenance and replacement interventions.

DESCRIPTION OF THE BACKGROUND ART

In the background art, various systems and methods have been proposed for determining the position and shape of the riser.

In a first approach, the shape of the riser is estimated using a characteristic numerical model of an elongated cylinder immersed in a fluid and with two known boundary conditions, consisting of the position of the floating platform and the position of the wellhead. This first approach does not allow determining the position of the floating platform, since the position of the platform is one of the essential input parameters of the numerical model used.

In a second approach, the shape of the riser is estimated using the same numerical model as in the first approach and, additionally, a further boundary condition consisting of the inclination measurement of the upper end of the riser in an upper flex joint.

Thereby, it is possible to calculate the position of the riser with more precision. The inclination measurement at the upper flex joint is taken by means of a detector fixed to the upper flex joint and connected by means of a cable to a computer located on the floating platform.

This second approach would allow determining the position of the floating platform, replacing, as a boundary condition, the position of the floating platform with the angle of inclination of the upper flex joint. The accuracy of the second approach, however, is not adequate for the purpose of a dynamic location of the floating platform.

In a third approach, the shape of the riser is estimated using the same numerical model as in the second approach and, additionally, a further boundary condition consisting of the inclination measurement of the lower end of the riser in a lower flex joint at the wellhead or at the Blow Out Preventer (BOP) arranged at the lower end of the riser. The inclination value of the lower flex joint is measured with a detector fixed to the lower flex joint and transmitted to the computer located on the floating platform by means of a control cable of the blow out preventer (BOP). Thereby, the inclination vectors at the upper flex joint and at the lower flex joint are measured and used in the numerical model of the shape and position of the riser, allowing a further improvement thereof. The accuracy of the third approach is adequate for the purpose of a dynamic location of the floating platform, but with a precision which drastically decreases with the increase of the sea depth.

In a fourth approach, the shape of the riser is estimated using a combined riser-floating platform numerical model and, additionally, a plurality of inclination and acceleration detectors is arranged along the riser extension, and the measurements taken by the further detectors are used as further input values for the numerical model of the shape and position of the riser.

The approaches of the background art have been described, for example, in U.S. Pat. No. 7,328,741, WO2015183491, US2016084066, WO198102442.

The known systems and methods for determining the shape and position of the riser still have a number of drawbacks, in particular an inaccuracy increasing with the increase of the sea depth, systematic errors due to the error arising from the integration of the data supplied by the accelerometers, an extreme uncertainty with regard to the global and local deformation of the riser string, in particular for high depths, a very small number of directly measurable boundary conditions (which do not require integration) with respect to a very high riser length.

It is thus the object of the invention to suggest a system and method for determining the shape and position of an underwater riser extending from a floating platform, having features such as to overcome at least some of the disadvantages of the background art.

It is a particular object of the invention to suggest a system and method for determining the shape and position of a riser, having features such as to improve the precision of the calculation of the shape and position of the riser.

These and other objects are achieved by means of a system for determining the shape, and possibly the position of an underwater riser extending from a floating platform, according to claim 1. The dependent claims relate to advantageous embodiments which solve further and more specific technical problems.

GENERAL DESCRIPTION OF THE INVENTION

According to an aspect of the invention, a system for determining the shape and, possibly, the position of an underwater riser extending from a floating platform, comprises:

- an electronic processing unit installed on the floating platform or on the riser, said processing unit being configured to calculate a deformed shape of the riser by means of a numerical model of the deformation of the riser as a function of a plurality of acceleration values and of a plurality of position values in predetermined points of the riser,
- a plurality of detection modules fixed to the riser in detection points along a longitudinal extension of the riser and in signal communication with the electronic processing unit, in which said detection modules comprise detection modules with at least one accelerometer which detects an acceleration value of the respective detection point and communicates it to the processing unit, characterized in that:

- said detection modules comprise detection modules with at least one pressure sensor which detects a water pressure value in the respective detection point and communicates it to the processing unit,
- said processing unit calculates said position values as a function of the measured water pressure values.

By knowing the water pressure, it is possible to directly derive the depths of the respective detection points of the riser with respect to the sea level and, therefore, a vector of the vertical positions of the detection points of the riser, without integration being required and without integration error.

Furthermore, the vector of vertical positions calculated as a function of the detected water pressure values may also be used to correct and/or improve the calculation of the position/translational and rotational displacement vectors with respect to the other degrees of freedom at the detection points of the riser, since the angle of inclination of the riser with respect to the vertical may be such to considerably influence also the vertical position of the individual detection points.

This streamlines the numerical model for the calculation of the deformation of the riser, speeds up the execution of the calculations and increases the precision of the knowledge of the real shape of the riser and, consequently, the precision and speed of the location of the vessel or floating platform.

BRIEF DESCRIPTION OF THE FIGURES

To better understand the invention and appreciate the advantages thereof, a number of non-limiting, exemplary embodiments will be described below, with reference to the Figures, in which.

DETAILED DESCRIPTION OF THE EMBODIMENTS

Figure 1:
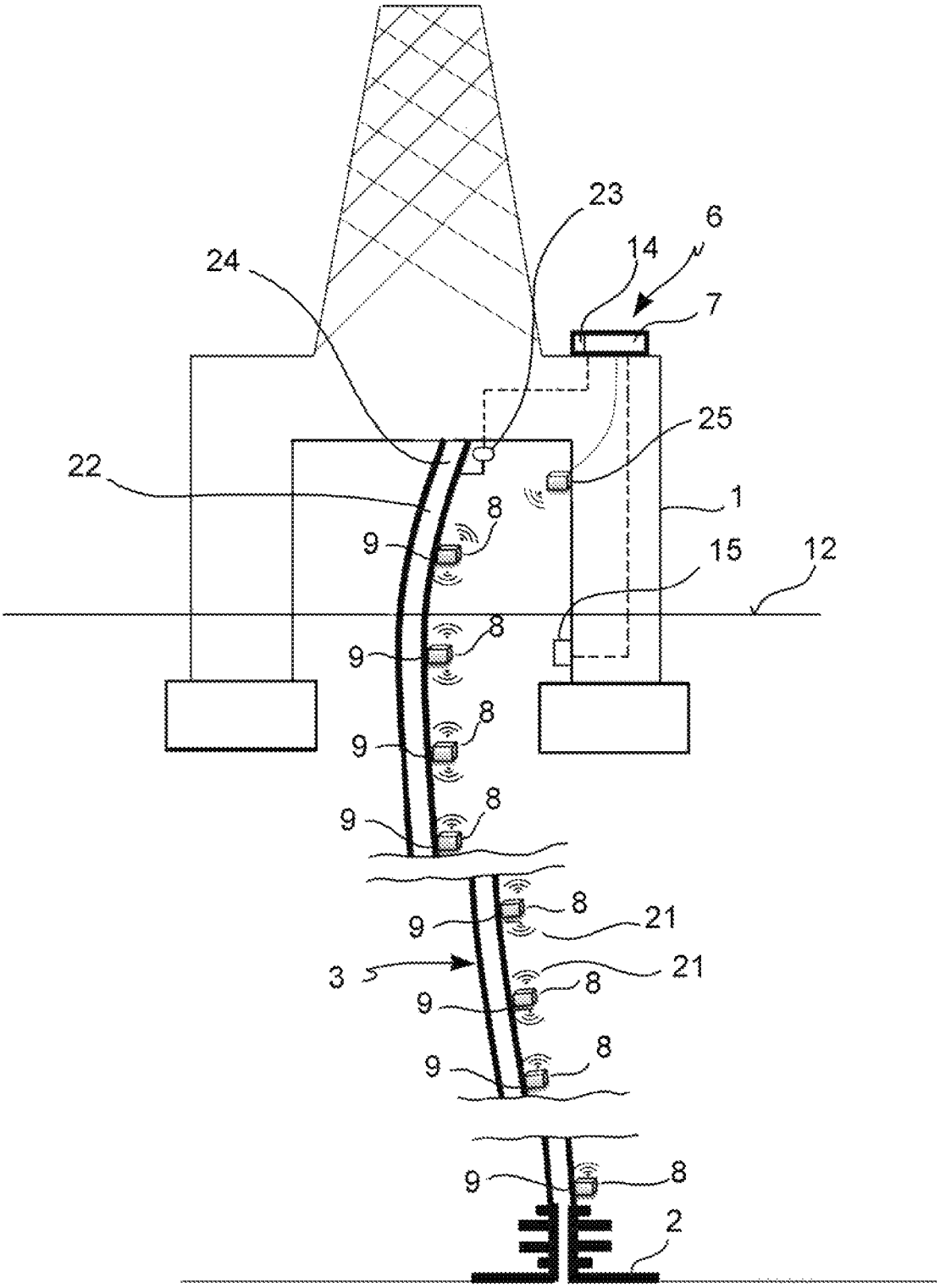
FIG. 1 shows an underwater riser extending between a floating platform and a wellhead on the seabed, and a system for determining the shape of the riser according to an embodiment of the invention.

FIG. 1 shows a floating platform 1, a fixed installation 2 on the seabed, for example a wellhead, on which a Blow Out Preventer (BOP) is installed, as well as a riser string 3 extending from the floating platform 1 downwards, up to the fixed installation 2.

The present invention relates both to the configuration shown in FIG. 1 and to a configuration, during the riser 3 installation step, in which the latter extends (and descends) from the floating platform 1 downwards, but without having already reached and/or without being already connected to the fixed installation 2.

Figure 4:
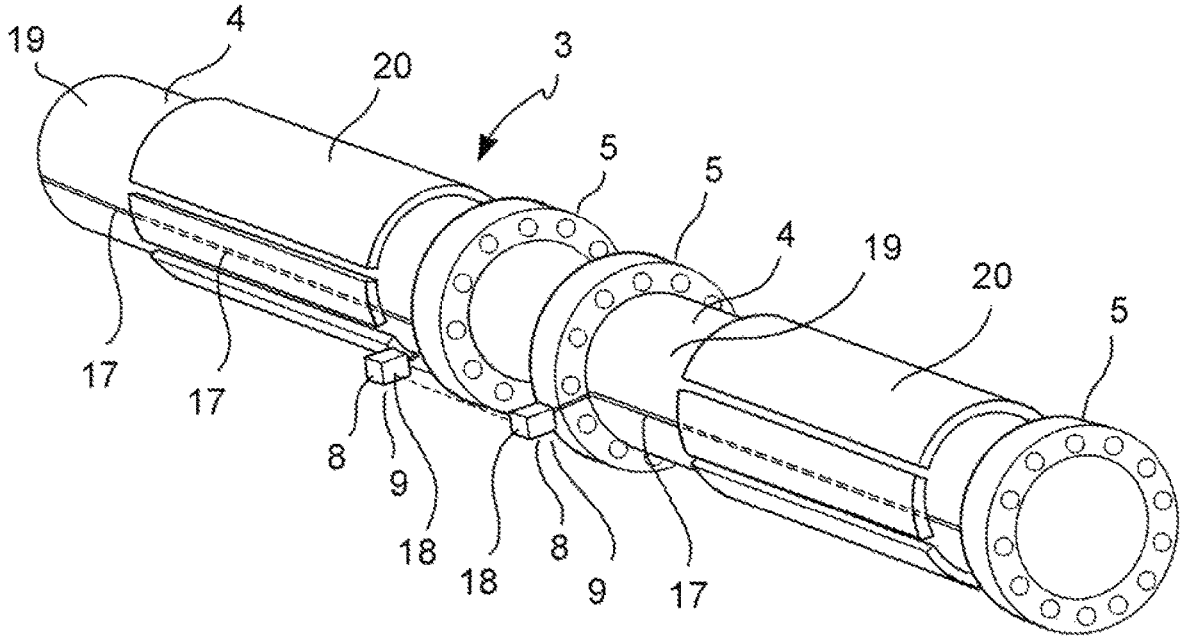
FIG. 4 shows two riser sections of a riser string according to an embodiment.

The riser 3 (often called riser string) usually consists of a plurality of elongated tubular segments 4 (e.g., 75 feet [=22.86 m] to 90 feet [=27.43 m] long and having a diameter 18¾ inches [476.25 mm] to 21 inches [=533.4 mm] wide), for example made of steel, with flanged ends 5 for a bolted connection therebetween (FIG. 4).

A system 6 for determining the shape and, possibly, the position of the riser 3 extending from the floating platform 1, comprises an electronic processing unit 7 installed, e.g., on the floating platform 1 or on the riser 3 and configured to calculate a deformed shape of the riser 3 by means of a numerical model of the deformation of the riser as a function of a plurality of acceleration values and of a plurality of position values in predetermined points of the riser 3. The processing unit 7 may comprise a computer with a processor, a memory, an executable program loaded into the memory, and a user interface.

The system 6 further comprises a plurality of detection modules 8 fixed to the riser 3 in predetermined detection points 9 along the longitudinal extension of the riser 3 and in signal communication with the processing unit 7.

Figure 5:
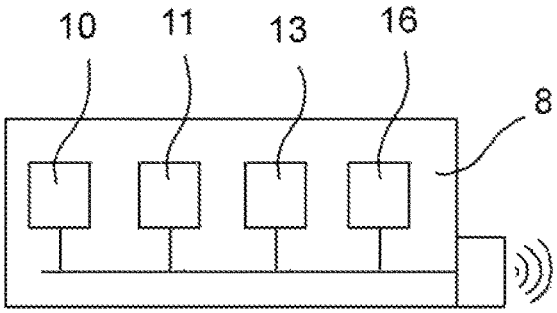
FIG. 5 shows a diagrammatic view of a detection module of the system according to an embodiment.

The detection modules 8 comprise modules with at least one accelerometer 10 which detects an acceleration value of the respective detection point 9 and communicates it to the processing unit 7 (FIG. 5).

Detailed Description of the Detection Modules 8

According to an aspect of the invention, the detection modules 8 comprise detection modules with at least one pressure sensor 11 which detects a water pressure value in the respective detection point 9 and communicates it to the processing unit 7, which processing unit 7 calculates the position values as a function of the measured water pressure values.

By knowing the water pressure, it is possible to directly derive the depths of the respective detection points 9 of the riser 3 with respect to the sea level 12 and, therefore, a vector of the vertical positions of the detection points 9 of the riser 3, without integration being required and without integration error.

Furthermore, the vector of vertical positions calculated as a function of the detected water pressure values may be used to correct and/or improve the calculation of the position/translational and/or rotational displacement vectors with respect to the other degrees of freedom at the detection points 9 of the riser 3.

This streamlines the numerical model for the calculation of the deformed shape of the riser 3, speeds up the execution of the calculations and increases the precision of the knowledge of the real shape of the riser 3 and, consequently, the precision and speed of the location of the vessel or floating platform 1.

According to an embodiment, the detection modules 8 comprise modules with a temperature sensor 13 which detects a water temperature value in the respective detection point 9 and communicates it to the processing unit 7, which processing unit 7 also calculates the position values as a function of the measured water temperature values.

By knowing the water temperature and applying a known relation between the temperature and the density of the water it is possible to calculate the depths of the respective detection points 9 of the riser 3 with respect to the sea level 12, with even greater precision.

According to a further embodiment, the system 6 may comprise an atmospheric pressure sensor 14 in signal connection with the processing unit 7 and arranged above (and preferably at a known vertical distance from) the sea level 12, for example fixed to the floating platform 1. The atmospheric pressure sensor 14 detects an atmospheric pressure value and communicates it to the processing unit 7, which processing unit 7 calculates the position values also as a function of the atmospheric pressure value.

By knowing the exact atmospheric pressure acting on the surface of the sea 12 it is possible to calculate with more precision the differences between the water pressure values detected at the detection points of the riser 3 and the atmospheric pressure at the surface of the water 12 and consequently, it is possible to calculate the depths of the respective detection points 9 of the riser 3 with respect to the sea level 12 with even greater precision.

According to a further embodiment, the system 6 may comprise a water density sensor 15, for example, a sensor which detects the weight of a water sample having a known volume (by virtue of a container with a calibrated volume) and a known temperature (since it is measured by means of a temperature sensor), in signal connection with the processing unit 7 and fixed, for example, to the floating platform 1. The water density sensor 15 detects a pair of sea water density and temperature values and communicates it to the processing unit 7, which processing unit 7 also calculates the position values as a function of the water density value.

By knowing the exact water density referred to a given temperature it is possible to calculate the depths of the respective detection points 9 of the riser 3 with respect to the sea level 12, with even greater precision.

Alternatively, the water density value at a given temperature may be provided to the processing unit 7 by means of a manual input, by means of a user interface, or by means of a signal connection to a database, e.g., of a remote laboratory.

Without detecting the water density, it is possible to determine the density value as a function of the water temperature (detected) and of predetermined density calculation curves or functions.

According to an embodiment, the detection modules 8 comprise modules with an inclination detector 16 (a so-called inclinometer or tiltmeter) which measures the inclination of the riser 3 with respect to the gravity direction in the respective detection point 9 and communicates the measured inclination value to the processing unit 7, which processing unit 7 also calculates the position values as a function of the measured inclination values.

By knowing the absolute inclination values of the riser 3 with respect to the vertical direction (gravity direction), at the selected detection points 9, it is possible to correct errors arising from the integration of the acceleration values and, thereby, improve the precision of the calculation of the deformed shape of the riser 3.

According to an embodiment, each of the detection modules 8 comprises an accelerometer 10 configured to detect the translational acceleration of the respective detection point 9 of the riser 3 at least on two horizontal axes, orthogonal to each other (axes x, y), and preferably also on a third vertical axis (axis z), and to communicate the detected acceleration values to the processing unit 7.

According to an embodiment, each of the detection modules 8 comprises, in addition to the accelerometer 10, one of said pressure sensors 11 and, preferably, one of said temperature sensors 13.

This allows a direct association, since it is referred to the same detection point 9, of the water pressure (and, preferably, temperature) values with the vector of the displacements of the detection point 9, calculated by integrating the detected acceleration values.

According to a further embodiment, each of the detection modules 8 comprises one of said inclination detector 16. This increases the number of known boundary conditions, since they are measured, and improves the precision and reliability of the calculation of the shape of the riser 3.

Advantageously, the inclination detector 16 is configured to detect the inclination of the respective detection point 9 of the riser 3 about two horizontal axes, orthogonal to each other (axes x, y) and, possibly, also about a third vertical axis (axis z).

According to an embodiment, the detection modules 8 are fixed, preferably permanently, to the segments 4 of the riser 3, preferably at the flanged end 5. A single riser segment 4 may comprise one or two or more than two detection modules 8.

According to a further embodiment, the system 6 may comprise a device 23 for detecting a relative position vector value between the floating platform 1 and a detection module 8 positioned at an upper end portion 22 of the riser 3, said device 23 being in signal connection with the processing unit 7 and the processing unit 7 being configured to calculate the position values of the detection points 9 and/or the position of the floating platform 1 also as a function of the detected relative position vector value.

The detection device 23 may comprise optical, acoustic or electromagnetic waves relative positioning sensors, e.g., one or more lasers, radars, cameras, extensometers, inclinometers, or displacement sensors of a telescopic joint 24 (FIG. 1) connected between the floating platform 1 and the upper end portion 22 of the riser 3, for determining a relative position vector between the floating platform 1 and the upper end of the riser 3.

Figure 2:
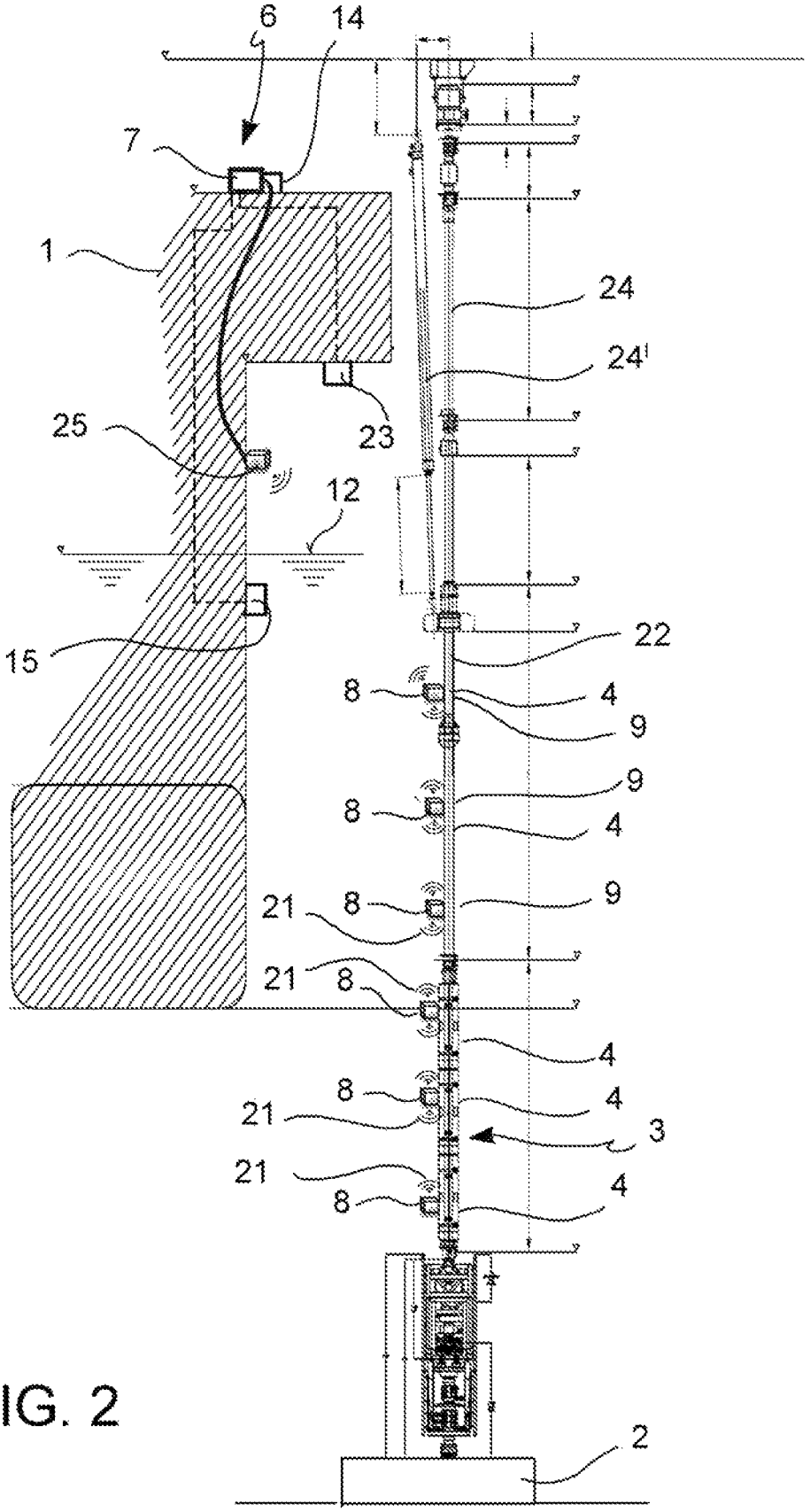
FIG. 2 shows an underwater riser extending between a floating platform and a wellhead on the seabed, and a system for determining the shape of the riser according to a further embodiment of the invention.

Alternatively or additionally, the system may comprise one or more detectors of the stroke and/or inclination of a tension cylinder (DAT cylinder, double acting telescopic cylinder) 24' (FIG. 2) also connected between the floating platform 1 and the upper end portion 22 of the riser 3, for determining a relative position vector between the floating platform 1 and the upper end of the riser 3.

Detailed Description of the Underwater Data Transmission

Figure 3:
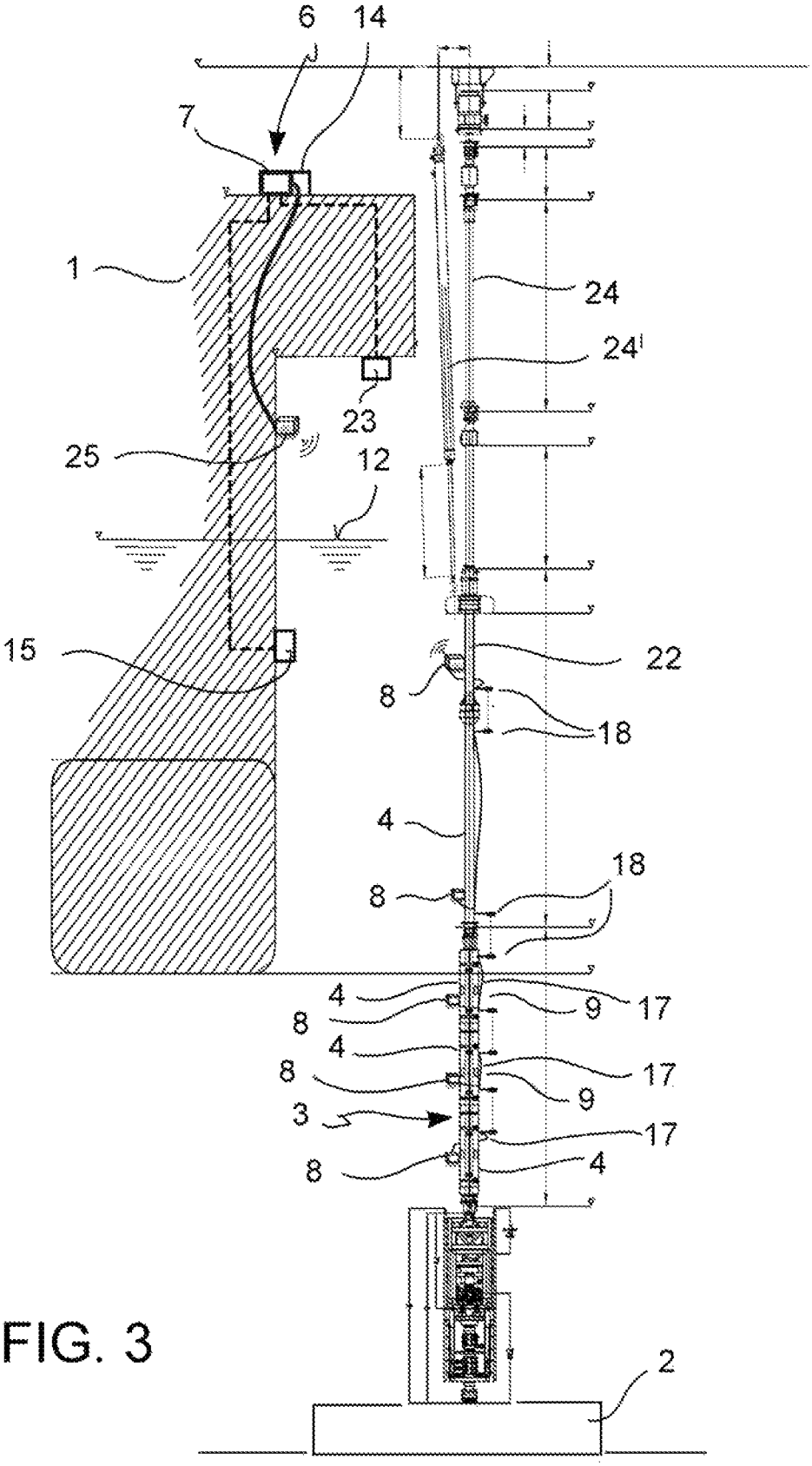
FIG. 3 shows an underwater riser extending between a floating platform and a wellhead on the seabed, and a system for determining the shape of the riser according to another further embodiment of the invention.

The signal connection between the detection modules 8 and the processing unit 7 may comprise contactless or wireless communication means (optical, radio frequency, electromagnetic), e.g., a plurality of optical conductors 17 (FIG. 3) extending along the longitudinal extension of the segments 4, respectively between two optical transmission interfaces 18 arranged at the flanged connection ends 5.

The optical conductor 17 may be clamped to the segment 4 and/or extending inside or outside a main tubular profile 19 (main tube), but preferably covered by a floating layer or element 20 of the segment 4.

The optical transmission interfaces 18 of two bordering ends 5, respectively, of two consecutive riser segments 4, directly face each other and are configured to transmit optical signals in a contactless manner, by means of an interstice or an interface plane therebetween.

The riser segments 4, each equipped with an own conductor 17 and transmitter 18 of optical digital signals, may be assembled, on board the floating platform 1, in a modular manner, to form the riser string 3 equipped with a continuous optical signal communication line.

Such continuous optical signal communication line may also act as a communication line for the control signals of the blow out preventer (BOP) and of possible further underwater systems at the lower end of the riser 3 and at the fixed installation 2 on the seabed.

The detection modules 8 are also permanently or removably fixed to the riser segments 4 and connected in signal communication to the optical conductor 17. The detection modules 8 and the optical transmission interfaces 18 may be arranged together in a single detection and transmission housing or they may be distinct devices, spaced apart from one another.

Alternatively, instead of the optical transmission interfaces 18 and the optical conductors 17, contactless induction transmission interfaces and electrical conductors may be included. Thereby, it is also possible to create an electric line along the riser string 3, capable of bringing power, and not only command signals, to the blow out preventer (BOP).

According to a further embodiment, the signal connection between the detection modules 8 and the processing unit 7 may comprise a plurality of radio frequency transceivers 21.

The radio frequency transceivers 21 of two consecutive segments 4 are configured to transmit radio frequency signals without the aid of cables.

The riser segments 4, each equipped with an own radio frequency transceiver 21, may be assembled, on board the floating platform 1, in a modular manner, to form the riser string 3 equipped with a continuous radio frequency signal communication line.

Such continuous radio frequency signal communication line may also act as a communication line for the control signals of the blow out preventer (BOP) at the lower end of the riser 3.

The detection modules 8 are permanently or removably fixed to the riser segments 4 and connected in signal communication to the transceivers 21. The detection modules 8 and the transceivers 21 may be arranged in a single detection and transmission housing or they may be distinct devices, spaced apart from one another.

The signal connection between an upper end 22 of the riser 3 and the processing unit 7 on board the floating platform 1 may comprise wireless communication means 25 (optical, radio frequency or electromagnetic).

Selection of the Detection Points 9

In order not to interfere with the assembly and downwards extension operations of the riser string 3 and to avoid doubts and errors in the arrangement of the detection points 9, it is advantageous to apply a detection module 8, systematically, at each connection point between two segments 4 of the riser 3, or at a fixed point, predetermined on each segment 4.

So as not to:

- weigh down the calculation of the shape of the riser 3 with measured values which, beyond a certain threshold of precision, may be considered redundant,
- congest the underwater communication line with the transmission of an excessive amount of measured values, the processing unit 7 divides the sensors 10, 11, 13, 16 or the detection modules 8 into a first group (included) and into a second group (excluded) and deactivates the second sensor group 10, 11, 13, 16 or detection modules 8 and/or calculates the shape of the riser 3 using only the values detected and supplied by the first sensor group 10, 11, 13, 16 or detection modules 8.

The processing unit 7 may perform such inclusion/exclusion of the sensors 10, 11, 13, 16 or of the detection modules 8 only once and effective for the entire calculation duration of the time history of the shape of the riser 3. Preferably, as a function of the installation conditions, in particular of the water depth, the inclusion/exclusion of the sensors 10, 11, 13, 16 or of the detection modules 8 may be selected at each descent of the riser 3.

Alternatively, the processing unit 7 may perform such inclusion/exclusion of the sensors 10, 11, 13, 16 or of the detection modules 8 several times and with only temporary effect during sub-intervals (for example at each second, fifth, tenth or hundredth time step) of the calculation duration of the time history of the shape of the riser 3.

The inclusion/exclusion of the sensors 10, 11, 13, 16 or of the detection modules 8 may occur according to a modal analysis of the riser 3 numerically modeled as an elastic cylinder immersed in a liquid, and in particular as a function of the natural vibrating modes thereof.

For example, temporarily:

- detection modules 8, positioned close to local extremity points of the natural vibrating modes, may be activated or used;
- detection modules 8, positioned close to nodes of natural vibrating modes, may be deactivated or ignored.

Based on experimental results, it is advantageous to include the first 15 modes in the decision to include/exclude sensors 10, 11, 13, 16 or detection modules 8.

Description of the Calculation Model of the Shape of the Riser

The processing unit 7 calculates the position of each detection point 9 with respect to a reference point at the floating platform 1 and/or at the fixed installation 2 on the seabed.

More precisely, the processing unit 7 calculates the time history of the position of each detection point 9 at predetermined time intervals, constant (for example, at each second) or adjusted as a function of the intensity of the variation of the shape of the riser 3 calculated.

The numerical model of the deformed shape of the riser 3 does not need to take into account the shape resulting from the elastic deformation of a beam with a constant cross section, nor the stresses and the effects of the inertia acting on the riser 3. It is possible to completely ignore the forces acting on the riser 3 and it is sufficient to model the shape of the riser 3 by means of a spline interpolation, dividing the entire length of the riser 3 into sub-intervals corresponding, for example, to a single segment 4 or to a plurality of segments 4, and selecting for each sub-interval a polynomial of degree d (preferably a square polynomial, d=2) and imposing the continuity of the first derivatives (d−1) at the meeting point between two bordering polynomials.

This simplifies the numerical model, allows to disregard the mechanical stresses for modeling purposes and speeds up the calculation of the deformed shape of the riser 3. This also makes the calculation of the deformation of the riser independent of the properties of the riser (such as, for example, inertia, elasticity and damping in the joints) which, in practice, are estimated and are therefore subject to errors and uncertainty.

Location of the Floating Platform 1

Knowing the position of the fixed installation 2 (wellhead) and the position of each detection point 9 along the riser 3 up to the floating platform 1, with respect to the position of the fixed installation 2, the processing unit 7 dynamically calculates (time-history analysis) the position of the floating platform 1 with respect to the fixed installation 2 and/or with respect to a global coordinate system, without the aid of the sonar or of a satellite GPS and not based on physical models (measures of stresses and structural properties, for example stiffness) of the riser 3.

Location of the Lower End (BOP) of the Riser 3

Knowing the position of the floating platform 1 and the position of each detection point 9 along the riser 3 up to the lower end (BOP) of the riser 3, with respect to the position of the floating platform 1, the processing unit 7 dynamically calculates (time-history analysis), during the descent of the riser 3, the position of the lower end (BOP) of the riser 3 with respect to the floating platform 1 and/or with respect to a global coordinate system, without the aid of the sonar and not based on physical models (measures of stresses and structural properties, for example stiffness) of the riser 3. This facilitates the approaching and coupling of the lower end of the riser 3 to the fixed installation 2 on the seabed.

Calculation of the Accumulation of Fatigue Damage of the Riser 3

The processing unit 7 calculates a fatigue damage or a residual fatigue life of the entire riser 3 or of the individual segments 4 of the riser 3 as a function of the history of the deformed shape of the riser 3 calculated (time history shape analysis) and stored. Furthermore, the processing unit 7 determines, as a function of the fatigue damage calculated or as a function of the time elapsed with the riser moving, one or more periods for the maintenance and/or replacement of the entire riser 3 or of individual segments 4 of the riser, and/or of individual connecting members (bolts) of the segments 4 of the riser. This entails savings in maintenance costs and increases the safety of drilling installations.

In fact the same riser segments 4 may be used in numerous drilling installations, but they are uniquely identifiable by virtue of the detection module 8 fixed thereto, and their history of fatigue stresses may be traced by virtue of the storage of the deformation history of all risers 3 in which the segment 4 has been used and/or by virtue of the history of "local" displacements/deformations of the segment 4 within the history of the deformation of the riser 3.

This allows to base a calculation of the period for the maintenance and replacement of the riser segments 4, no longer on a simple but not accurate criterion of age (for example, 5 years), but on a more accurate criterion of service age (for example, 1000 days in water and subject to dynamic deformation), or based on the actual fatigue state of the riser.

In the description provided so far, the steps of the method have been carried out by components of the system 6, including the processing unit 7. However, the invention also explicitly relates to a method for determining the shape of the riser 3 which may be implemented by means of alternative means other than the electronic processing unit 7.

The term "deformed shape" also includes the shape of the riser when it is not deformed with respect to a reference shape thereof, for example, vertical rectilinear.

Further changes and variations may be obviously made by those skilled in the art to the system and method for determining the position and shape of the underwater riser 3 according to the present invention, in order to meet contingent and specific needs, all changes and variations being included in fact in the scope of protection of the invention as defined by the following claims.

The invention claimed is:

1. A system for determining the shape and position of an underwater riser extending from a floating platform, comprising:

an electronic processing unit installed on the floating platform or on the riser, said processing unit being configured to calculate a deformed shape of the riser by means of a numerical model of the deformed shape of the riser as a function of a plurality of acceleration values and of a plurality of position values in predetermined points of the riser, a plurality of detection modules fixed to the riser in detection points along a longitudinal extension of the riser and in signal communication with the electronic processing unit, wherein said detection modules comprise detection modules with at least one accelerometer which detects an acceleration value of the respective detection point and communicates it to the processing unit, wherein said detection modules comprise detection modules with at least one pressure sensor which detects a pressure value of the water in the respective detection point and communicates it to the processing unit, wherein said processing unit calculates said position values as a function of the measured pressure values of the water wherein the signal connection between the detection modules and the processing unit comprises wireless communication means, wherein the signal connection between the detection modules and the processing unit comprises optical conductors extending along the longitudinal extension of segments between two optical transmission interfaces, respectively, arranged at the connection ends of said riser segments, and wherein the optical transmission interfaces of two bordering connection ends directly face each other, respectively, and are configured to transmit contactlessly optical signals.

2. A system according to claim 1, wherein the detection modules comprise modules with a temperature sensor which detects a temperature value of the water in the respective detection point and communicates it to the processing unit, wherein the processing unit calculates the position values also in dependency of the measured water temperature values.

3. A system according to claim 1, comprising an atmospheric pressure sensor in signal connection with the processing unit, wherein the atmospheric pressure sensor detects an atmospheric pressure value and communicates it to the processing unit, and the processing unit calculates the position values also in dependency from the atmospheric pressure value.

4. A system according to claim 1, wherein the detection modules comprise modules with an inclination detector which measures the inclination of the riser with respect to the gravity direction in the respective detection point and communicates the measured inclination value to the processing unit, and the processing unit calculates the position values also in dependency of the measured inclination values.

5. A system according to claim 1, wherein each of the detection modules comprises an accelerometer configured to detect the translational acceleration of the respective detection point of the riser on two axes, orthogonal to each other and orthogonal to a longitudinal axis of the riser, and to communicate the detected acceleration values to the processing unit.

6. A system according to claim 5, wherein said accelerometer is configured to detect the translational acceleration of the respective detection point of the riser also on a third axis parallel to the longitudinal axis of the riser.

7. A system according to claim 5, wherein each of the detection modules comprises one of said pressure sensors.

8. A system according to claim 7, wherein each of the detection modules comprises one of said temperature sensors.

9. A system according to claim 5, wherein each of the detection modules comprises one of said inclination detectors, wherein said inclination detector is configured to detect the inclination of the respective detection point of the riser about two horizontal axes, which are orthogonal to each other.

10. A system according to claim 1, wherein the detection modules are fixed to riser segments which can be connected together to form the riser, wherein each riser segment comprises at least one of said detection modules.

11. A system according to claim 1, comprising detectors for detecting a relative position vector value between the floating platform and a detection module positioned at an upper end portion of the riser, said detectors being in signal connection with the processing unit and the processing unit calculates the position values of the detection points and the position of the floating platform also as a function of the detected relative position vector value.

12. A system according to claim 1, wherein the signal connection between the detection modules and the processing unit comprises a plurality of radio frequency transceivers connected to consecutive riser segments and configured to transmit signals chain-like from one riser segment to the next.

13. A system according to claim 1, wherein the riser is formed by a succession of mutually and removably connected riser segments, and said detection points are positioned at each connection point between two riser segments, respectively.

14. A system according to claim 1, wherein the riser is formed by a succession of mutually and removably connected riser segments, and said detection points are positioned in a predetermined fixed point on each riser segment.

15. A system according to claim 1, wherein the processing unit divides the sensors of the detection modules into a first group and a second group, and calculates the shape of the riser using only the values detected and supplied by the first sensor group.

16. A system according to claim 15, wherein the processing unit performs the division into the first group and into the second group with only temporary effect during sub-intervals of the calculation duration of the time history of the shape of the riser.

17. A system according to claim 15, wherein the processing unit performs the division into the first group and into the second group according to a modal analysis of the riser numerically modeled as an elastic cylinder immersed in a liquid.

18. A system according to claim 1, wherein the processing unit calculates the time history of the position of each detection point at predetermined time intervals.

19. A system according to claim 1, wherein the processing unit calculates the time history of the position of the floating platform with respect to a fixed installation on the seabed to which the riser is connected, and with respect to a global coordinate system.

20. A system according to claim 1, wherein the processing unit calculates, during a descent of the riser from the floating platform towards an installation on the seabed, the time history of the position of a lower end of the riser with respect to the floating platform and with respect to a global coordinate system.

21. A system according to claim 1, wherein the processing unit calculates a maintenance period of the riser according to the time history of the calculated deformed shape of the riser.

22. A method for determining the shape and position of an underwater riser extending from a floating platform, comprising:

calculating, by means of an electronic processing unit, a deformed shape of the riser by means of a numerical model of the deformed shape of the riser as a function of a plurality of acceleration values and of a plurality of position values in predetermined points of the riser, detecting, by means of accelerometers, acceleration values of the riser in a plurality of detection points along a longitudinal extension of the riser, detecting the pressure values of the water in at least some of said detection points, and calculating said position values as a function of the measured pressure values of the water;

wherein a signal connection between the detection points and the processing unit comprises wireless communication means, wherein the signal connection between the detection points and the processing unit comprises optical conductors extending along a longitudinal extension of segments between two optical transmission interfaces, respectively, arranged at connection ends of said riser, and wherein optical transmission interfaces of two bordering connection ends directly face each other, respectively, and are configured to transmit contactlessly optical signals.

* * * * *